US009421582B1

(12) United States Patent
Zolnierek et al.

(10) Patent No.: US 9,421,582 B1
(45) Date of Patent: Aug. 23, 2016

(54) PIVOTING CENTRIFUGAL PARTS CLEANER

(71) Applicant: AMERIKAM, INC., Grand Rapids, MI (US)

(72) Inventors: Michael Zolnierek, Wyoming, MI (US); Daniel J. Lang, Wyoming, MI (US)

(73) Assignee: Amerikam, Inc., Grand Rapids, MI (US)

( * ) Notice: Subject to any disclaimer, the term of this patent is extended or adjusted under 35 U.S.C. 154(b) by 75 days.

(21) Appl. No.: 14/165,669

(22) Filed: Jan. 28, 2014

(51) Int. Cl.
*B08B 3/04* (2006.01)
*B08B 3/06* (2006.01)
*B08B 3/02* (2006.01)

(52) U.S. Cl.
CPC . *B08B 3/045* (2013.01); *B08B 3/06* (2013.01); *B08B 3/02* (2013.01)

(58) Field of Classification Search
None
See application file for complete search history.

(56) References Cited

U.S. PATENT DOCUMENTS 2,239,904 A * 4/1941 Soderberg ..... 134/159
2,418,691 A * 4/1947 Bjering ..... B08B 9/32 134/112
2,431,418 A * 11/1947 Olen ..... D06F 27/00 68/143
2,887,354 A * 5/1959 Lichtenstein ..... D06F 43/04 68/152
3,744,402 A * 7/1973 Piegza ..... A23L 3/14 134/153
3,973,989 A * 8/1976 Senger ..... B08B 3/06 134/112
4,370,992 A * 2/1983 Choudhury ..... B08B 3/00 134/100.1
5,482,064 A 1/1996 Goddard
6,044,852 A * 4/2000 Epperson et al. ..... 134/56 R
6,374,644 B1 * 4/2002 Rhode ..... D06F 37/08 24/58
8,349,270 B2 * 1/2013 Winzinger ..... B08B 1/00 134/104.1
2008/0302398 A1 * 12/2008 Jasper ..... 134/112
2009/0114252 A1 * 5/2009 Robert et al. ..... 134/25.1
2011/0284038 A1 * 11/2011 Bang ..... B08B 3/022 134/166 R

FOREIGN PATENT DOCUMENTS

DE 3937199 A1 5/1991
DE 102010060995 A1 6/2012
FR 2960802 A1 12/2011
GB 2232877 A 1/1991
GR 1006096 B2 5/2007
IT 1239948 B 11/1993

OTHER PUBLICATIONS

Photos of parts cleaner put into service Apr. 2007, at Amerikam, Inc., 1337 Judd Ave SW, Grand Rapids, MI 49509.

* cited by examiner

*Primary Examiner* — Michael Barr
*Assistant Examiner* — Cristi Tate-Sims
(74) *Attorney, Agent, or Firm* — McGarry Bair PC

(57) ABSTRACT

A centrifugal parts cleaner having a housing, a hub disposed within the housing rotatable about a vertical axis, a driver to rotate the hub, at least two radial arms extending from the hub and a cradle pivotally connected to the at least two radial arms configured to receive a porous container for retaining parts to be cleaned. As the hub is rotated, the cradle pivots away from the hub to retain the parts in the porous container while allowing fluid on the parts to be extracted by centrifugal force.

14 Claims, 2 Drawing Sheets

PIVOTING CENTRIFUGAL PARTS CLEANER

BACKGROUND OF THE INVENTION

1. Field of the Invention

The invention relates generally to a parts cleaning apparatus and more specifically, but not exclusively, to a centrifugal parts cleaning apparatus for cleaning parts covered with a fluid.

2. Description of the Related Art

During the process of machining, it is common to use fluids to lubricate parts in order to reduce wear on equipment and to facilitate the machining process. However, fluid residue left on parts after the machining process is generally unwanted and often removed. One common way to remove the fluid from parts is to wash the parts with a solvent capable of removing or dissolving the fluid. One drawback of such a process, however, is that the fluid removed from the parts cannot be reclaimed without an expensive secondary process. Moreover the solvent itself is often expensive. It is also known to remove fluid from parts using centrifugal force. Parts are placed in a centrifuge and spun until the fluid is removed from the parts. Such a process however, imparts a great deal of force on the parts and has the capability to dislodge parts, causing damage and lost parts.

SUMMARY OF THE INVENTION

In one aspect, the invention relates to a pivoting centrifugal parts cleaner having a housing, a hub disposed within the housing rotatable about a vertical axis, a driver to rotate the hub, at least two radial arms extending from the hub and a cradle pivotally connected to the at least two radial arms configured to receive a porous container for retaining parts to be cleaned. As the hub is rotated, the cradle pivots outward to retain the parts in the porous container while allowing fluid on the parts to be removed by centrifugal force.

In another aspect, the pivoting centrifugal parts cleaner may include a hydraulically operated cover for selectively providing access to the housing and control system for operating the centrifugal parts cleaner according to a cycle of operation. The control system may be configured to spin the hub at a set speed for a set amount of time.

In yet another aspect, the housing may be configured to collect to the fluid removed from the parts so as to be reused in subsequent operations. The fluid removed from the parts may come into contact with the inside surfaces of the housing and drain into a sump disposed beneath the housing.

DESCRIPTION OF THE PREFERRED EMBODIMENT

Figure 1:
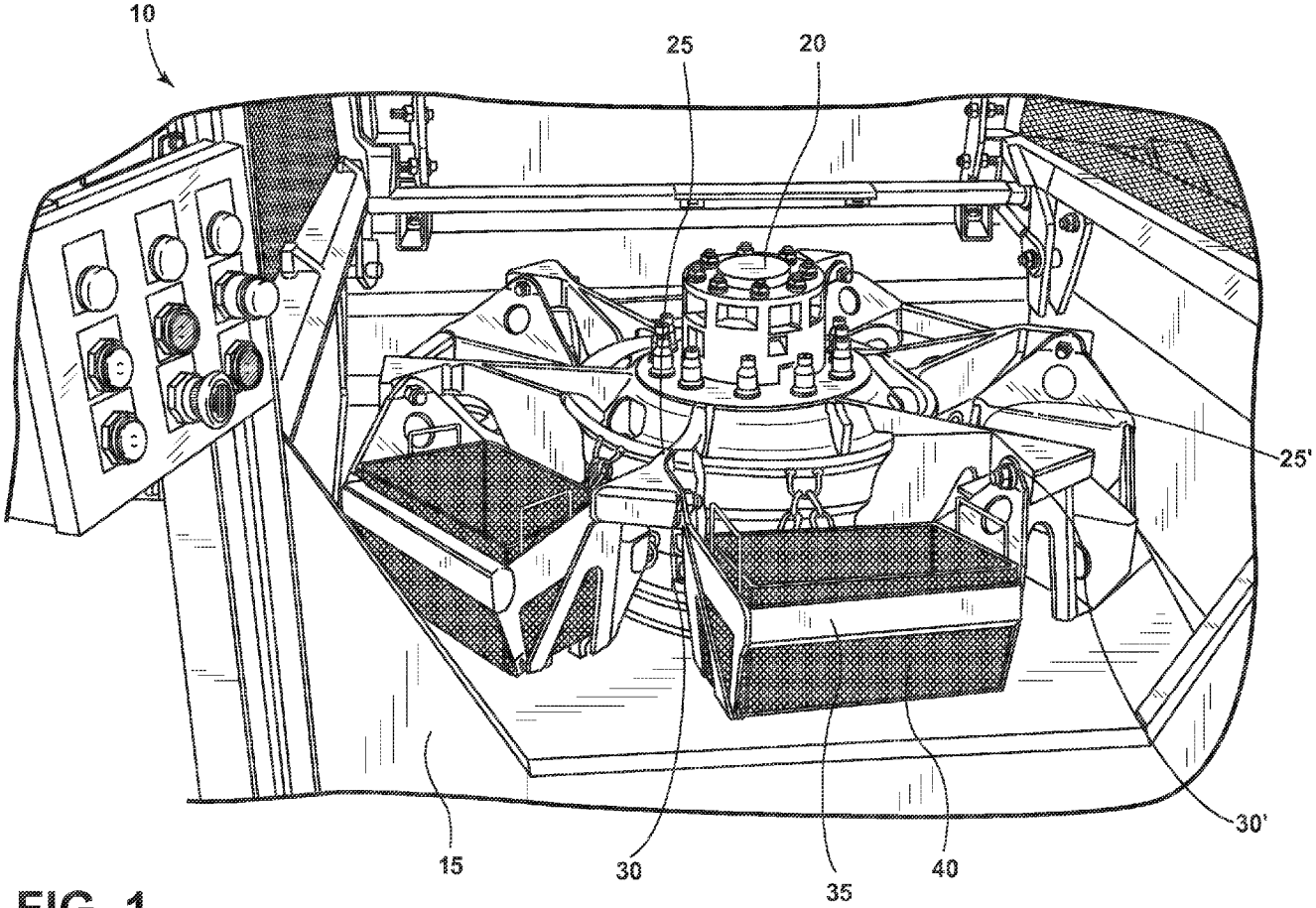
FIG. 1 is a perspective view of a pivoting centrifugal parts cleaner according to an embodiment of the invention.

Turning now to the drawings and to FIG. 1 in particular, there is shown a perspective view of a pivoting centrifugal parts spinner or cleaner according to a an embodiment of the invention. The pivoting centrifugal parts cleaner 10 comprises a housing 15, a rotatable hub 20, a driver 145 shown in FIG. 2, at least two radial arms 25, 25', and at least one pivoting cradle 35. The rotatable hub 20 is mounted in the housing 15 so as to rotate about an axis. Preferably the axis will be vertical or at least substantially vertical. The driver 145 (FIG. 2) is connected to rotatable hub 20 to cause the rotatable hub 20 to rotate. The radial arms 25, 25' connect to the rotatable hub 20 and project outwards away from the rotatable hub 20 forming pivoting mounting locations 30, 30' at the end opposite the rotatable hub 20. The four vertical sides and the bottom horizontal side of the pivoting cradle 35 form a rectangular box supporting structure and the top horizontal side forms an opening to receive a porous container 40. The vertical sides and horizontal bottom of the pivoting cradle 35 are configured to secure the porous container 40 and to provide voids or open spaces to expose the porous container 40. The pivoting cradle 35 further comprises two pivoting mounting locations located above the top horizontal side opening which correspond to the radial arms 25, 25' pivoting mounting locations 30, 30' and the pivoting cradle 35 is pivotally mounted to the radial arms 25, 25' at the pivoting mounting locations 30, 30'. The four vertical sides and the bottom horizontal side of the porous container 40 form a porous rectangular box supporting structure and the top horizontal side forms an opening to receive parts.

When the driver 145 (FIG. 2) rotates the rotatable hub 20, the radial arms 25, 25' connected to the rotatable hub 20 also rotate. The pivoting cradle 35 pivotally connected to the radial arms 25, 25' at pivoting mounting locations 30, 30' also rotates along with the radial arms 25, 25' and the rotatable hub 20. In turn, the porous container 40 seated in the pivoting cradle 35 rotates as well. As the pivoting cradle 35 and porous container 40 rotate about a vertical axis at the center of the rotatable hub 20, a centrifugal force which draws a rotating body away from the center of rotation, is imparted to the pivoting cradle 35 and to porous container 40. Because the pivoting cradle 35 and porous container 40 are pivotally connected to the radial arms 25, 25' at the pivoting mounting locations 30, 30' which lie substantially above the rectangular box supporting structure of the pivoting cradle 35 and porous container 40, the centrifugal force causes the pivoting cradle 35 and porous container 40 to pivot on the radial to the pivoting mounting locations 30, 30' about the horizontal axis between the two pivoting mounting locations 30, 30' away from the rotatable hub 120.

Fluid covered parts held in the porous container 40 as it pivots away from the rotatable hub 20 are held in place by the centripetal force or the normal force created by the sides and bottom of the porous container 40. However, the pores in the porous container 40 are large enough to allow fluid to pass through; therefore, the fluid on the fluid covered parts has no centripetal force or normal force to hold it in place or resist the centrifugal force acting to draw the fluid away from the center of rotation of the rotatable hub 20. In this way, the centrifugal force acting on the fluid draws the fluid away from the rotatable hub 20, through the porous container 40 and off the parts, thereby extracting the fluid from the parts.

Figure 2:
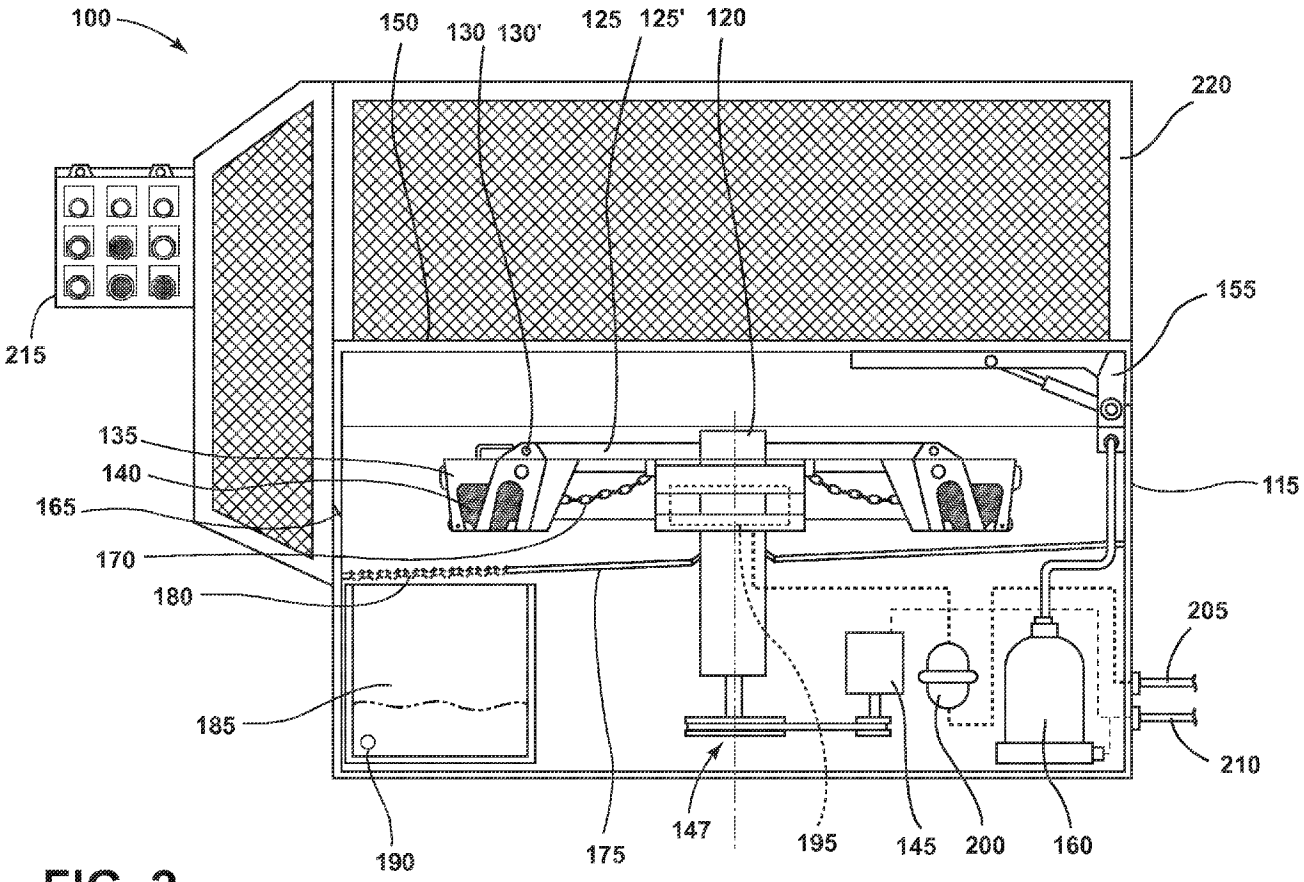
FIG. 2 is a schematic view of a pivoting centrifugal parts cleaner according to an embodiment of the invention.

FIG. 2 illustrates a schematic view of a pivoting centrifugal parts cleaner 100 according to the invention. Many parts of the pivoting centrifugal parts cleaner 100 of FIG. 2 are similar to the centrifugal parts cleaner 10 of FIG. 1. Thus, like parts will be identified with like numerals of FIG. 1, except the numerals will be increased by 100.

The centrifugal parts cleaner 100 is similar that of FIG. 1 in that it comprises a housing 115, a rotatable hub 120, a driver 145 to rotate the rotatable hub 120, at least two radial arms 125, 125', and at least one pivoting cradle 135. The radial arms 125, 125' connect to the rotatable hub 20 and project outwards away from the rotatable hub 120 forming a pivoting mounting location 130, 130' at the end opposite the rotatable hub 120. The four vertical sides and the bottom horizontal side of the pivoting cradle 135 form a rectangular box supporting structure and the top horizontal side forms an opening to receive a porous container 140. The vertical sides and horizontal bottom of the pivoting cradle 135 are configured to secure the porous container 140 and to provide voids to expose the porous container 140. The pivoting cradle 135 further comprises two pivoting mounting locations located above the top horizontal side opening which correspond to the radial arms 125, 125' pivoting mounting locations 130, 130' and the pivoting cradle 135 is pivotally mounted to the radial arms 125, 125' at the pivoting mounting locations 130, 130'. The four vertical sides and the bottom horizontal side of the porous container 140 form a porous rectangular box supporting structure and the top horizontal side forms an opening to receive parts.

A tether 170 connects the pivoting cradle 125 to the rotatable hub 120. Preferably the tether 170 is adjustable so that a user can change its length and thus control the degree of pivot. Ideally, the tether 170 limits the degree of pivot of the pivoting cradle 120 to optimize the fluid removal from the parts held in the porous container 140 and prevent parts held in the porous container 140 from falling out as well as to secure the pivoting cradle 135 if the mounts at the pivoting mounting locations 130, 130' were to fail.

The pivoting centrifugal parts cleaner 100 may further comprise different systems and components to enhance functionality and safety of the pivoting centrifugal parts cleaner 100. The different systems include an access system, a fluid collection system, a drive system, a braking system, a safety system and a control system.

The access system comprises a cover 150 to selectively provide access to the at least one pivoting cradle 135. The cover 150 may be hydraulically operated by a hydraulic hinge 155 and a hydraulic power unit 160. When access to the at least one pivoting cradle 135 is prevented, a seal 165 is created between the housing 115 and the cover 150.

The fluid collection system comprises a bottom wall 175 of the housing 115 which is sloped from one side of the housing 115 to the other. It is preferred that the lowest point of the sloped bottom wall 175 is at the opposite side of the housing as the hydraulic hinge 155. A fluid porous screen 180 is formed in the lowest side of the bottom wall. The other walls of the housing 115 may also be sloped towards the screen 180 and the lowest point of the sloped bottom wall 175. A removable sump 185 is disposed beneath the screen 180 and the housing 115. A fluid removal port 190 is disposed at the bottom of the sump 185. The fluid removal port 190 allows fluid contained in the sump 185 to be drained or pumped from the sump 185.

The drive system comprises the driver 145 which is connected to the rotatable hub 120 by a pulley system 147. The pulley system 147 may consist of a flywheel mounted to a shaft in communication with the rotatable hub 120 and a belt in communication with the driver and the flywheel. The rotatable hub 120 extends through the bottom wall 175 wherein the bottom wall 175 may form a seal around the rotatable hub 120 or an inclined lip around the rotatable hub 120 to prevent fluid leakage between the rotatable hub 120 and the bottom wall 175. In other embodiments, the driver 145 may be directly coupled to the rotatable hub 120 or use gears to connect to the rotatable hub 120.

The braking system comprises an air brake 195 mounted within the rotatable hub 120 to stop rotation of the rotatable hub 120. The air brake 195 is connected to a diaphragm 200 for controlling the air brake 195 which is mounted beneath the bottom wall 175 of the housing 115. A compressed air line 205 may supply the diaphragm 200 and air brake 195 with compressed air.

The safety system comprises guarding 220 disposed around cover 150 and housing 115 to protect against injury from moving components of the pivoting centrifugal parts cleaner 100. The guarding may further include light curtains, emergency stops and other safety devices well known in the art.

The control system comprises a control panel 215 that is mounted to the guarding 220 or the housing 115 to control the operation of the cover 150, driver 145, air brake 195 and other components as well as the electrical power supply 210 supplied to those components. The control panel 215 may have a processor to permit or restrict operations of different components and systems based on certain criteria. For example, the processor may not allow the driver 145 to rotate if the cover 150 is not in sealing contact with the housing 115. The processor may also be programmed to control the speed of rotation of the rotatable hub 120 and the duration of rotation. The control panel 120 may further comprise a user interface to display information about a cycle of operation and to control the different components and operations of the pivoting centrifugal parts cleaner 100.

The operation of the pivoting centrifugal parts cleaner 100 of FIG. 2 will now be explained. Using the control panel 215, the cover 150 may be automatically opened to gain access to the at least one pivoting cradle 135. Opening the cover 150 via the control panel 215 activates the hydraulic power unit 160 which pumps hydraulic fluid into the hydraulic hinge 155 causing the cover 150 to open. Each pivoting cradle 135 may then receive a porous container 140 containing fluid covered parts. After the porous containers 140 are placed in the pivoting cradles 135, the cover 150 may be shut to form a seal 165 with the housing 115 using the control panel 215. When shutting, the hydraulic fluid is removed from the hydraulic hinge 155 and returned to the hydraulic power unit 160. It is also possible to manually open the shut the cover 150 in case of a hydraulic failure.

A cycle of operation may then be initiated using the control panel 215. According to one cycle of operation, the driver 145 is rotated at a predetermined speed. The speed may be dependent on the type of fluid, the type of parts and/or the amount of parts and may vary at predetermined times during the cycle of operation. The rotating driver 145 rotates the rotatable hub 120 using the pulley system 147.

As the rotating hub 120 rotates, a centrifugal force is generated causing the pivoting cradle 135 to pivot on the radial to the pivoting mounting locations 130, 130' about the horizontal axis between the two pivoting mounting locations 130, 130' away from the rotatable hub 120. The degree of the pivot is limited by the tether 170 in order to optimize the fluid removal and ensure the parts remain in the porous container 140.

The porous container 140 secured by the pivoting cradle 135 creates a centripetal force or normal force on the parts held in the porous container 140 but not on the fluid covering the parts which acts to hold the parts in the porous container 140. The centrifugal forces generated acting on the fluid draw it away from the center of rotation of the rotating hub 120, off the parts and through the pours in the porous container 140 thereby extracting the fluid from the parts.

The fluid is then decelerated by housing 115, and cover 150. The forces of gravity acting on the fluid cause it to flow off the cover 150 and side walls of the housing 115 onto the bottom wall 175 of the housing 115. The downward slope of the bottom wall 175 directs the fluid to the screen 180 where debris and contaminants are removed from the fluid as the fluid passes through the screen 180 and into the sump 185. If the sump 185 becomes full of fluid, the fluid may be drained or pumped out of the sump 185 through the fluid removal port 190.

After a predetermined time optimized for the fluid, parts and/or amount of parts, the rotation of the driver 145 is stopped and the air brake 195 is activated. The diaphragm 200 releases the compressed air held in the diaphragm 200 causing the airbrake 195 to provide resistance to the rotation of the rotatable hub 120 until all rotation of the rotatable hub 120 is halted.

Once rotation of the rotatable hub 120 is stopped, the cover 150 may opened to once again gain access to the at least one pivoting cradle 135 as described above. The porous containers 140 containing parts may be removed. The cover 150 may then be automatically shut using the control panel 215 as described above at which point the process may be repeated.

In one embodiment, a pivoting centrifugal parts cleaner containing six pivoting cradles effectively removes the fluid from parts held in porous containers seated in the pivoting cradles when the rotatable hub is rotated at between 50 and 200 revolutions per minute for between 3 to 10 minutes, however, it will be understood that the pivoting centrifugal parts cleaner according to this invention may be configured to rotated at any speed for any amount of time.

It will further be understood the different components of the pivoting centrifugal parts cleaner may be made from any material well known in the art of those individual components.

The embodiments described above provide for a variety of benefits including an effective means to remove fluid from parts and recollect the fluid removed from the parts. The pivoting cradle 135 and porous container 140 provide the benefit of being able to hold a multitude of parts of different shapes. The pivoting action of the pivoting cradle 135 prevents the parts from being removed from the porous container 140 due to the centrifugal force generated during rotation of the rotatable hub 140 making is less likely to loose or damage parts during the cleaning operation.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A centrifugal parts spinner comprising;

a housing, a rotatable hub mounted in the housing for rotation about a first axis, a driver connected to the rotatable hub to cause the hub to rotate, at least two radial arms extending radially from the hub, and at least one cradle pivotally connected to and between the at least two radial arms for pivotal movement on a second axis normal to the first axis, wherein the at least one cradle is configured to hold fluid-covered parts, whereby when the hub is rotated about the first axis, with fluid-covered parts disposed in the at least one cradle, the at least one cradle will pivot about the second axis on the radial arm to which it is pivotally connected while the fluid is extracted from the parts by centrifugal force.

2. The centrifugal parts spinner of claim 1 further comprising a cover on the housing movable between open and closed positions, wherein fluid is maintained within the housing when the cover is in the closed position.

3. The centrifugal parts spinner of claim 2 where the cover is operated hydraulically, manually, or automatically.

4. The centrifugal parts spinner of claim 1 further comprising a sump beneath the housing to collect fluid extracted from the parts.

5. The centrifugal parts spinner of claim 1 comprising a plurality of radial arms.

6. The centrifugal parts spinner of claim 1 having a tether connected between the at least one cradle and the hub to limit pivoting.

7. The centrifugal parts spinner of claim 6 wherein the tether is adjustable.

8. The centrifugal parts spinner of claim 1 where the cradle has open spaces to allow fluid to move there through.

9. The centrifugal parts spinner of claim 1 further comprising a braking system within the hub to stop rotation of the hub.

10. The centrifugal parts spinner of claim 1 wherein the first axis is substantially vertical.

11. The centrifugal parts spinner of claim 1 wherein the housing includes a bottom wall that is sloped.

12. The centrifugal parts spinner of claim 1 further comprising at least one porous container dimensioned to removably fit within the at least one cradle and adapted to hold the parts.

13. The centrifugal parts spinner of claim 1 wherein the at least one cradle has vertical sides and a horizontal bottom having voids.

14. The centrifugal parts spinner of claim 3 further comprising a safety system disposed around the cover and the housing.

* * * * *